United States Patent [19]

Nakahara et al.

[11] Patent Number: 4,843,670

[45] Date of Patent: Jul. 4, 1989

[54] METHOD FOR COLORING TEXTILE USING A COLOR SUPPLY DRUM AND A COLOR SUCTION DRUM

[75] Inventors: Shuichi Nakahara, Nishinomiya; Toru Koide, Yao; Michinobu Kaimori, Nara; Kenji Kitamura, Suzuka; Satoshi Matsumoto, Takatsuki, all of Japan

[73] Assignee: Kanebo, Ltd., Osaka, Japan

[21] Appl. No.: 130,126

[22] Filed: Dec. 8, 1987

Related U.S. Application Data

[62] Division of Ser. No. 8,884, Jan. 30, 1987, Pat. No. 4,742,699.

[51] Int. Cl.[4] ..... D06B 5/08

[52] U.S. Cl. ..... 8/151

[58] Field of Search ..... 68/200, 202, 203; 401/10, 197; 118/50, 211, 259, 411; 101/119; 8/151

[56] References Cited

U.S. PATENT DOCUMENTS

| | | | |
|---|---|---|---|
| 1,545,988 | 7/1925 | Thomayer | 68/203 |
| 2,573,097 | 10/1951 | Epstein | 68/203 |
| 3,750,567 | 8/1973 | Taguchi et al. | 68/202 X |
| 3,890,811 | 6/1975 | Fleissner | 68/200 |
| 4,535,611 | 8/1985 | Masuda | 68/202 |

FOREIGN PATENT DOCUMENTS

| | | | |
|---|---|---|---|
| 554330 | 6/1970 | U.S.S.R. | 68/202 |

*Primary Examiner*—Philip R. Coe

*Attorney, Agent, or Firm*—Armstrong, Nikaido, Marmelstein, Kubovcik & Murray

[57] ABSTRACT

This invention provides a method and an apparatus for direct formation of a stripe pattern on a textile substrate such as sliver. The object of the invention is to dispense with a gill which would interfere with a high-speed feed of said textile substrate and thereby improve the efficiency of coloration. In accordance with this invention, a color supply hollow drum (2) and a color suction hollow drum (3) are vetically juxtaposed and a continuous length of fibrous material is continuously fed between said two drums (2), (3) by rotation thereof. As the substrate material is thus fed, a color composition is supplied from color supply grooves (8) of the color supply hollow drum (2) while it is drawn by a suction force acting in color suction grooves (13) of the color suction hollow drum (3) to cause the color composition to strike through the fibrous substrate material to thereby form color stripes of substantially the same configuration as that of the above-mentioned grooves on the fibrous substrate material.

2 Claims, 13 Drawing Sheets

METHOD FOR COLORING TEXTILE USING A COLOR SUPPLY DRUM AND A COLOR SUCTION DRUM

This is a division of application Ser. No. 008,884 filed Jan. 30, 1987, and now U.S. Pat. No. 4,742,699.

FIELD OF TECHNOLOGY

The present invention relates to a method and an apparatus for forming color patterns such as stripes on sliver and other textile materials.

BACKGROUND TECHNOLOGY

Formation of stripes and other patterns on sliver and other textile materials has heretofore been carried out by Vigoureux printing and the products on which such stripes have been formed are used in the fabrication of sprinkly colored woven fabrics, among others. Such Vigoureux printing is generally carried out by means of the apparatus shown in FIG. 17. Thus, the Vigoureux printing machine generally indicated by the reference numeral 430 comprises a mounting base 431, a color box 432 mounted thereon, a color supply roll 433 disposed in said color box 432, a felt roller 434 which is in pressure contact with said color supply roller 433, and an engraved roller 435 disposed in juxtaposition with said felt roller 434. In addition, a gill 436 implanted with a multiplicity of needles is mounted on said base 431. Slivers 438 are drawn out from within a plurality of cans 437, lined up horizontally on a roller 439 and fed to said gill 436 at which they are formed into a sheet-like web 440. The web is then passed between said felt roller 434 and engraved roller 435, whereby it is printed with a color paste supplied from the color box 432. The printed web is raised up by a first and a second hoisting rollers 441, 442 and swung down by an oscillating folding device 443 on a product bench 444. As illustrated in FIG. 18, the printing operation by said felt roller 434 and engraved roller 435 takes place as the sheet-like web 440 is fed between the felt roller 434 picking up the color paste and the engraved roller 435 having a spiral pattern of projections 445 on its circumferential surface so that a stripe pattern 446 is reproduced on the web under the pressure of said spiral pattern of projections 445.

The Vigoureux printing machine 430 has a long history and has been commonly employed in the manufacture of sprinkly-colored worsted yarn. However, since it is difficult to print thick textile materials with this conventional machine, the sliver 438 must be passed through a gill 436 to form a sheet-like web before being printed. Therefore, even if it is desired to increase the rate of sliver feed for an improved color printing efficiency, the passage through the gill is rate-limiting, for the gill inherently does not lend itself well to high speed production because of its construction features and, moreover, tends to cause breakage of fiber when the sliver is passed at the allowable maximum speed. The result is that the printing efficiency cannot be increased beyond a certain level. Moreover, in the above conventional Vigoureux printing machine 430, the felt on the felt roller 434 is compressed and hardened as the machine is repeatedly operated so that it becomes less and less efficient to pick up the color and as it is used over a long period of time, the shade of the print becomes not so deep as desired. Furthermore, the above machine 430 is only compatible with dry fibrous substrates and cannot be an element in a continuous production line connected to the ground dying process, thus preventing the layout of a continuous dyeing-printing plant. As the above machine thus includes a gill 436 which cannot deal with a wet ground-dyed sliver, it cannot be built into a continuous processing line along with the sliver ground-dyeing process. In this way, the conventional Vigoureux printing machine has several problems in regard to coloring efficiency, uniformity of color prints and the freedom of integration with a ground-dyeing process for material fibers such as sliver. Particularly, in the field of Vigoureux printing, technical innovation has been slow as compared with the other segments of dyeing art and an early resolution of the above-mentioned problems has been keenly demanded.

OBJECT OF THE INVENTION

The object of the present invention is to provide a method and an apparatus for coloring textile materials to a stripe or other pattern with high efficiency and uniformity and in a continuous line integrated with a ground dyeing process for the textile materials.

DISCLOSURE OF THE INVENTION

The present invention relates, in a first aspect, to a method of coloring textile materials which comprises passing a continuous length of fibrous substrate through a vertically juxtaposed set of a color supply drum and a color suction drum, supplying a color composition from color supply means on the circumference of said color supply drum and, at the same time, drawing the color composition by means of a suction force applied by color suction means on the circumferential surface of said color suction drum to impregnate said fibrous substrate with said color composition at appropriately spaced intervals. The present invention relates, in its second aspect, to an apparatus for use in practicing said method, which comprises a vertically juxtaposed set of a color supply drum and a color suction drum with a clearance therebetween for the passage of a continuous length of fibrous material, said color supply drum being provided on the circumferential surface thereof with a plurality of axially-extending color supply means disposed at predetermined intervals in the circumferential direction thereof and said color suction drum being provided on the circumferential surface thereof with a plurality of axially-extending color suction means disposed at predetermined intervals in the circumferential direction thereof, and a rotary drive means for driving said two drums in synchronism so that said color supply means of said color supply drum are successively lined up with said color suction means of said color suction drum through said clearance provided for passage of the fibrous substrate material.

EFFECTS OF THE INVENTION

In accordance with the present invention, unlike conventional Vigoureux printing, a fibrous substrate material is passed through a clearance between two hollow drums while a color composition is supplied from color supply means disposed on the circumference of one of said hollow drums and drawn by suction with color suction means on the circumference of the other drum to cause the color composition to strike through the thickness of said fibrous substrate material to thereby color the material, thus permitting direct coloration of even a thick web. This arrangement does not require the use of a gill which has heretofore been essential and unavoidable, and since the feed rate of fibrous substrate material is not limited by the gill, a remarkable increase in coloration efficiency is implemented. Furthermore, because the gill is not employed, a stripe pattern may be printed on a fibrous substrate which has just been ground-dyed and is still wet, so that the ground dyeing and pattern printing can be integrated into a continuous processing line. In addition, as the invention does not use a felt roll which has been employed in prior art technology, uniform coloration over a long term can be assured without replacement of parts.

BEST MODE OF WORKING THE INVENTION

The present invention is hereinafter described in detail by reference to its preferred embodiments.

Figure 1:
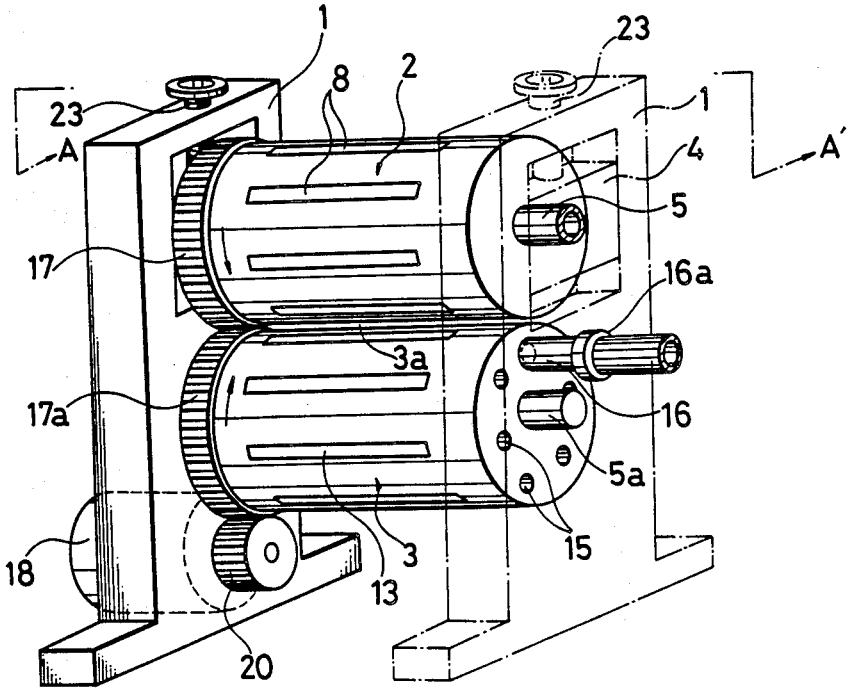
FIG. 1 is a perspective exterior view showing an embodiment of the present invention.
Figure 2:
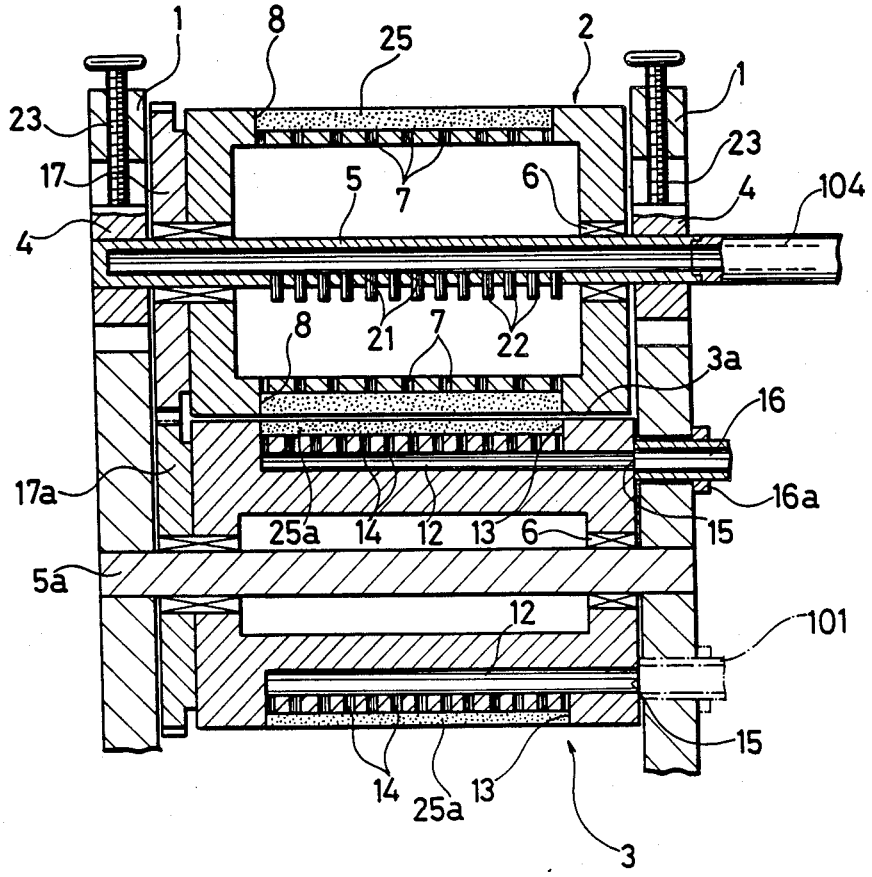
FIG. 2 is a sectional elevation view taken along the line A—A' of FIG. 1.
Figure 3:
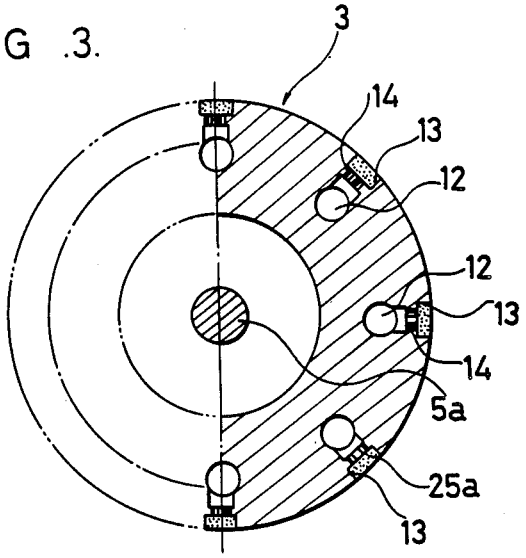
FIG. 3 is a transverse sectional view of the color suction hollow drum shown in FIG. 1.

FIG. 1 is a perspective exterior view showing an embodiment of the present invention and FIG. 2 is a sectional elevation view taken along the line A—A'. In these views, the reference numeral 1 represents a pair of metallic frames. Mounted on said pair of frames 1 are a stainless steel color supply hollow drum 2 and a stainless steel color suction hollow drum 3 in vertically juxtaposed arrangement with a clearance 3*a* for passage of a textile substrate therebetween. The color supply hollow drum 2 is rotatably mounted on a main shaft 5 secured rigidly to shaft holders 4 of the frames 1 through bearing means 6 and adapted to revolve in its circumferential direction. The peripheral surface of this hollow drum 2 is provided with a plurality of color supply grooves 8 in circumferentially spaced-apart positions, each of said color supply grooves having a plurality of color supply holes 7 at its bottom. Rigidly fitted in each of said color supply grooves 8 is an open-cell hydrophilic polyvinyl formal sponge member 25. This polyvinyl formal sponge 25 is manufactured by mixing polyvinyl alcohol with a pore-forming agent such as starch, a mineral acid catalyst, and formalin and rinsing the reaction product formal to remove the starch, mineral acid catalyst, etc., thus leaving pores after removal of starch particles. This polyvinyl formal sponge 25 is intended to retain the color and has an appropriate degree of hydrophilicity such that in color change, the color can be easily washed away with water. For this point of view, it is preferable to use a polyvinyl formal sponge with a porosity or void volume ratio of 70 to 95%, more preferably 86 to 92%, a degree of formalization in the range of 70 to 90%, more preferably 80 to 86%, and a pore size distribution of 100 to 1000 μm, more preferably 200 to 700 μm. The color suction hollow drum 3 mentioned hereinbefore is rotatably mounted on a main shaft 5*a* fixed rigidly to the frame 1 via bearing means 6 and adapted to revolve in its circumferential direction. The exterior circumferential surface of this hollow drum 3 is provided with a plurality of color suction grooves 13 (See FIG. 3) in circumferentially equi-spaced positions, each of said color suction grooves 13 being associated with a channel hole 12 located underneath thereof. Said color suction groove 13 is communicating with said channel hole 12 through color passageways 14, and one end of said channel hole 12 being exposed to form an orifice at 15 on the mirror-finished surface of the color suction hollow drum 3 at the corresponding end thereof. The reference numeral 16 represents a polyfluoroethylene suction cylinder connected to a conventional vacuum pump (not shown), the open end of the suction cylinder being secured in position by a locking metal 16*a* in a position adjacent to one side of said hollow drum 3 near its top portion. The above suction cylinder 16 is adapted to introduce a suction force from said vacuum pump into the suction groove 13 when the suction orifice 15 of the channel hole 12 of said color suction hollow drum 3 has arrived at the clearance 3*a* for passage of a textile substrate and lined up with the opening of the suction cylinder 16. Rigidly fitted in said color suction groove 13 is a polyolefin sponge 25*a* which is designed to equalize the suction pressure over the whole color suction groove 13 and prevent entry of dust. This sponge 25*a* has an open-cell structure but unlike the sponge 25 fitted in the color supply groove 8, its pore size is confined to a narrow range of 150 to 500 μm. More preferably, the pores are in the range of 200 to 300 μm. This restriction on pore size is imposed to assure a more positive prevention of the entry of dust and an improved distribution of suction forces. The above color supply hollow drum 2 and color suction hollow drum 3 are respectively provided with gears 17 and 17*a* which are in mesh with each other, and the gear 17*a* of the color supply hollow drum 3 is further in mesh with a gear 20 which is driven by a motor 18 (FIG. 1). In this arrangement, said color supply hollow drum 2 and color suction hollow drum 3 are driven in synchronism to bring said plurality of color supply grooves 8 and plurality of color suction grooves 13 into alignment with each other in succession through said clearance 3*a* for passage of the textile substrate. The main shaft 5 of said color supply hollow drum 2 is a hollow shaft which is provided with a plurality of holes 21 in suitable axially spaced-apart positions along its lower side. Fitted in each of these holes 21 is a nozzle 22 which is adapted to evenly spray a color composition fed into the main shaft 5. On the other hand, the main shaft 5*a* of said color suction hollow drum 3 is a solid shaft.

The above-mentioned hollow main shaft 5 is supplied with a color composition containing a dye or pigment as a main ingredient by constant-rate pumps (not shown) through a pipe 104. In this manner, the color composition is supplied into the main shaft 5 of color supply hollow drum 2 just before each of said supply grooves 8 is lined up with the mating color suction groove 13. Regarding the color suction hollow drum 3, as mentioned above, every time one of its color suction grooves 13 arrives at the clearance 3*a* for passage of a textile substrate as the drum 3 is driven in synchronism with said color supply hollow drum 2, a vacuum suction is applied by the vacuum pump via said channel hole 12. As a result, the color composition supplied in a metered flow at timed intervals into the main shaft 5 of the color supply hollow drum 2 flows down from the nozzles 22 via said holes 21 of the main shaft 5 into the interior of said color supply hollow drum 2 and, then, reaches the supply groove 8 via the channels 7 at its bottom. The polyvinyl formal sponge 25 in said color supply groove 8 serves to assure a uniform distribution of color in the longitudinal direction of the color supply groove 8 and when the groove 8 is lined up with the suction groove 13, the color composition is carried by the suction force of the vacuum pump from the groove 8 to the suction groove 13, to the holes 14 and to the channel hole 12 and is finally drained off from the suction cylinder 16. The spent color composition is supplemented with coloring matter for reuse and fed again to the main shaft 5 of the color supply hollow drum 2. Indicated at 23 is a screw element with a hand-wheel, which is adapted to raise or lower the shaft holder 4 so as to adjust the clearance 3*a* between the color supply hollow drum 2 and color suction hollow drum 3.

Figure 4:
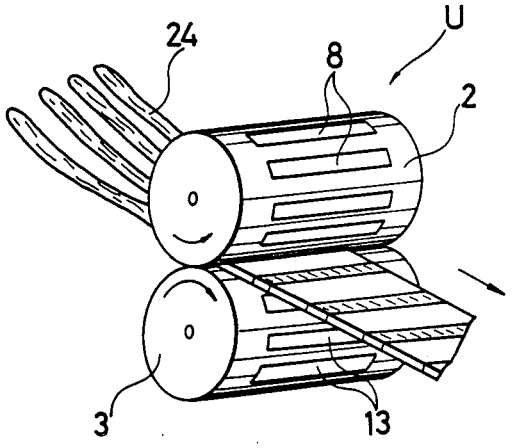
FIG. 4 is a schematic view illustrating the operation of the apparatus of FIG. 1.
Figure 5:
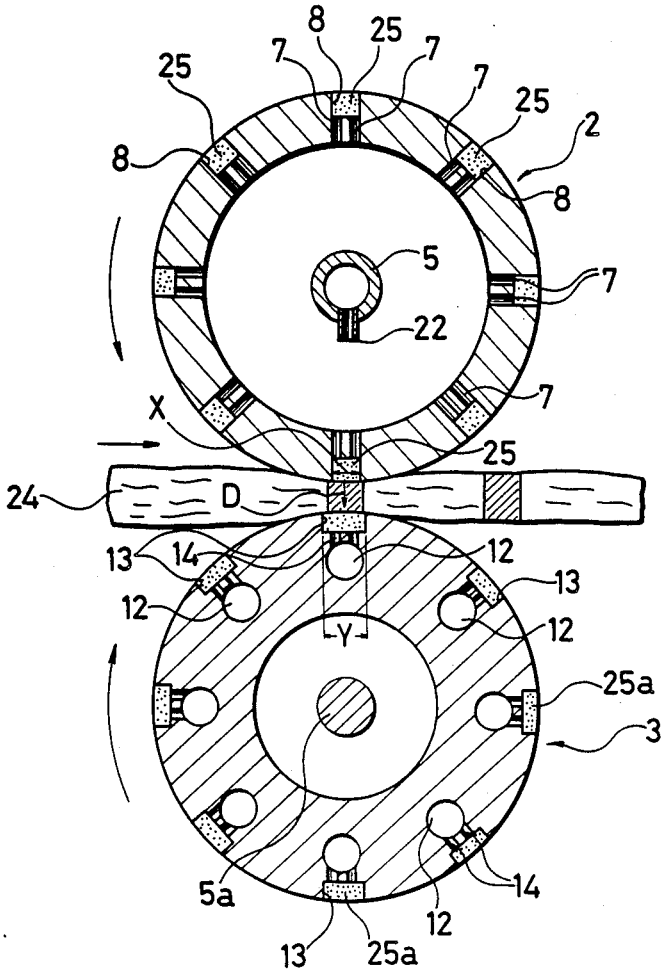
FIG. 5 is a sectional view showing the passage of the color through slivers.
Figure 6:
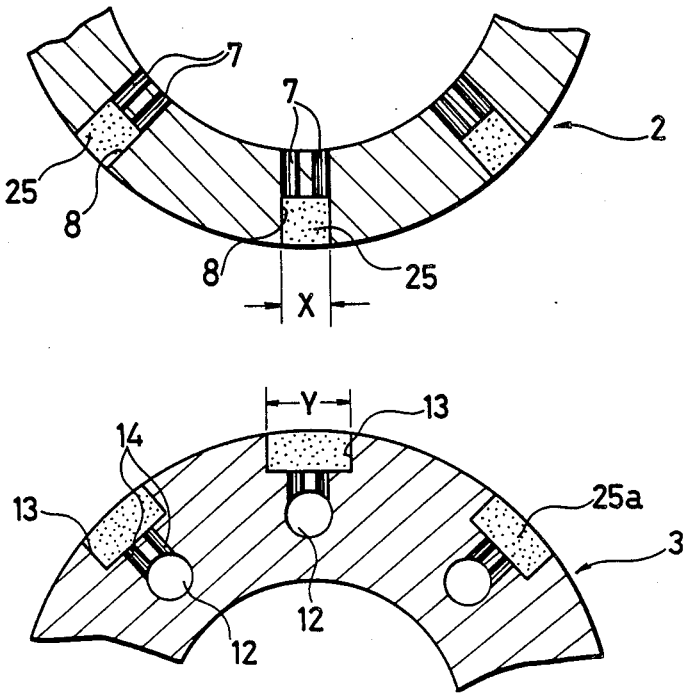
FIG. 6 is a sectional view illustrating the difference in width between the color supply groove and color suction groove of the apparatus illustrated in FIG. 1.
Figure 7:
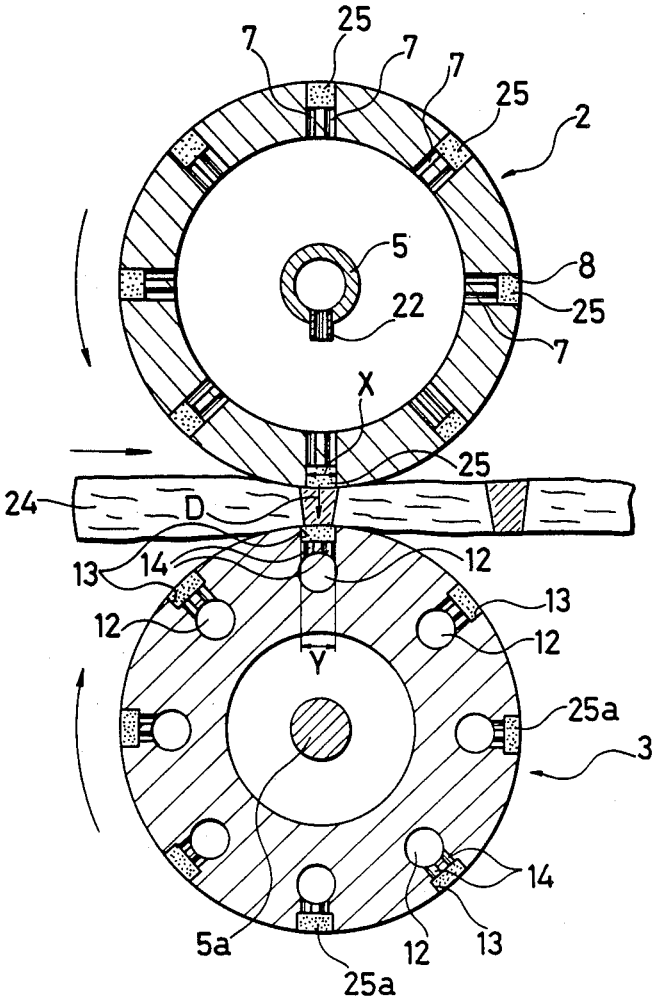
FIG. 7 is a schematic view illustrating the result when it is assumed that the supply and suction grooves have the same width.

In the above arrangement, a motor 18 is driven to rotate the gears 17 and 17*a* in the directions respectively indicated by arrow-marks in FIG. 1 and several to tens of wool slivers 24 aligned in parallel are passed through the clearance 3*a* between said color supply hollow drum 2 and color suction hollow drum 3 as illustrated in FIG. 4. While the individual slivers 24 prior to entry into said clearance 3*a* retain their large-diameter cord-like configuration, they are compressed into a substantially flat sheet as they pass through said clearance 3*a* and as shown in FIG. 5, this sheet is colored to a pattern of stripes with suitable spacings as the color composition flows in the direction of arrow-mark D when the color supply grooves 8 of the color supply hollow drum 2 are successively lined up with-the color suction grooves 13 of the color suction hollow drum 3. In this connection, as shown in FIG. 6, the groove width Y of said color suction groove 13 is designed to be larger than the groove width X of the color supply groove 8 of the color supply hollow drum 2. Generally, the ratio of groove width Y to groove width X is set in the range of 1.25 to 1.35. Because the width Y of suction groove 13 is thus set larger than the width X of supply groove 8, the individual stripe is formed with a substantially uniform diffusion width across the sliver from the top side to the bottom side thereof as indicated by shading in FIG. 5. Incidentally, if the groove width Y of color suction groove 13 and the groove width X of color supply groove 8 are equal to each other, each line of the stripe pattern will be greater in width at the top side of the sliver 24 than at the bottom side as shown in FIG. 7, with the result that the sliver will not be uniformly colored between the top and bottom sides. The interval of individual stripes in the stripe pattern formed with an equal diffusion width from the top side to the bottom side of the sliver is substantially equal to the circumferential spacing between the supply grooves 8 of color supply hollow drum 2 and between the suction grooves 13 of color suction hollow drum 3. A plurality of slivers 24 are thus colored simultaneously and formed into a sheet or web. Particularly as, in this apparatus, the polyvinyl formal sponge 25 is securely set into the supply groove 8 of color supply hollow drum 2, the color composition fed out from the main shaft 5 of the hollow drum 2 is uniformly retained by the open-cell polyvinyl formal sponge 25 and this evenly held color composition is caused to pass across the sliver 24 by the negative pressure from the color suction hollow drum 3 when said supply groove 8 comes into alignment with said suction groove 13. As a result, uniform color printing results are obtained.

Thus, in accordance with this embodiment, as the color composition is forced across the fibrous substrate, such as wool sliver, by the negative pressure acting in the color suction hollow drum 3, even a thick fibrous material can be directly colored and the use of a gill which has been an essential adjunct to the conventional machine can be dispensed with. Therefore, the feeding rate for the fibrous material is not subject to the speed limit imposed by the use of a gill so that the printing speed can be remarkably increased. Moreover, just because the use of a gill is dispensed with, the sliver 24 or other fibrous material in wet condition after ground dyeing can be immediately fed to the above apparatus for stripe printing so that a continuous dyeing-pattern printing line can be implemented. Since this printing operation for the formation of a stripe pattern is carried out by means of a negative pressure, there is an additional advantage that the bleeding of the stripe pattern is minimal even when the fibrous material is fed in wet condition. Furthermore, since the two hollow drums 2 and 3 are both made of stainless steel and, unlike felt, are not compressed and hardened with time, there is no problem of the coloring effect being diminished as the apparatus is operated for a long time.

Figure 8:
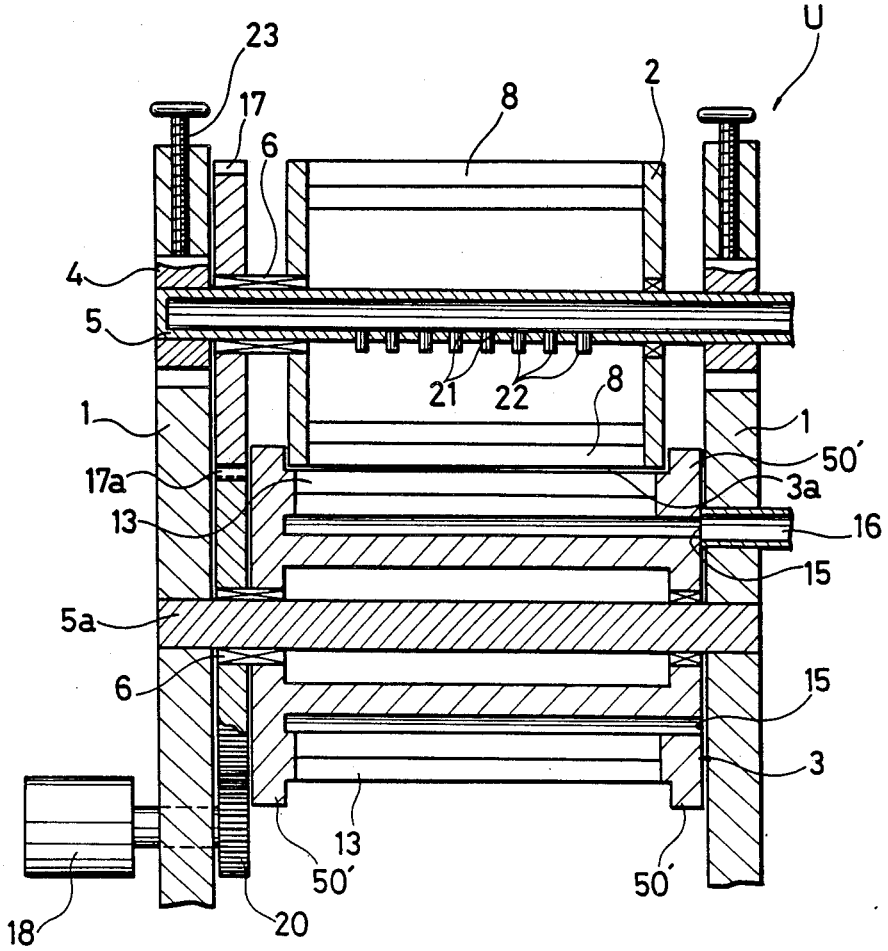
FIG. 8 is a sectional elevation view showing another embodiment of the present invention.
Figure 9:
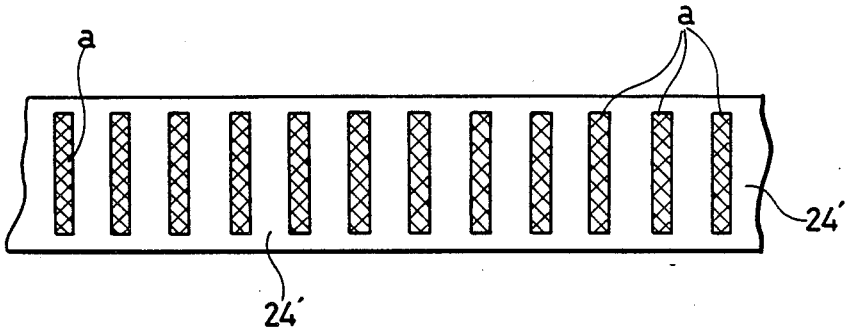
FIG. 9 is a schematic view illustrating the stripe pattern produced with the apparatus shown in FIG. 1.
Figure 10:
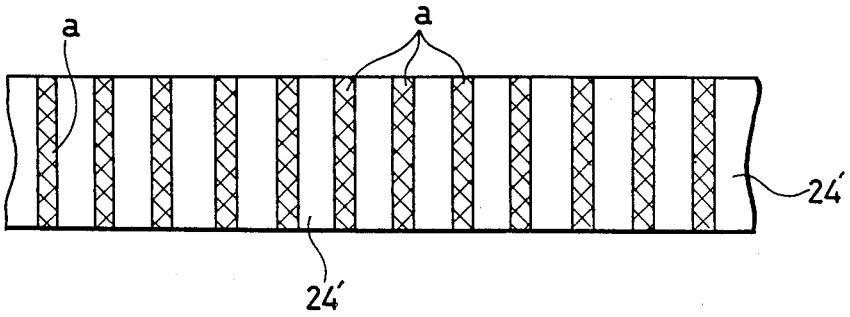
FIG. 10 is a schematic view illustrating the stripe pattern formed with the apparatus shown in FIG. 8.

FIG. 8 illustrates another embodiment of the present invention. The apparatus according to this embodiment comprises a color suction hollow drum 3 provided with a flange 50' at either side along the circumference thereof, with each of its suction grooves 13 extending close to the two flanges 50' and a color supply hollow drum 2 positioned snugly between said two flanges 50'. Otherwise, the arrangement of component parts is similar to that in the apparatus according to the embodiment of FIG. 1. In this second embodiment, a plurality of slivers (not shown) passing through a clearance 3*a* between the two hollow drums 2 and 3 at right angles therewith upon rotation of said hollow drums 2 and 3 are kept at an appropriate dimension at the clearance 3*a* by the width-limiting function of the flanges 50' and the suction force applied from the suction groove 13 extending to the full width acts on the whole width of slivers so that the desired stripe pattern is reproduced on the entire width of slivers. Thus, with the apparatus illustrated in FIG. 1, the portions of the sliver or other fibrous material which pass through the zones where the suction grooves 13 are not available are not printed and depending on cases, the fibrous material 24' remains uncolored at both edges as illustrated in FIG. 9. In FIG. 9, the reference symbol a represents individual stripes constituting a stripe pattern. With the apparatus according to the present embodiment, stripes a are formed over the full width of the fibrous material 24' so that the stripe pattern is always formed over the whole width of the fibrous material.

Figure 11:
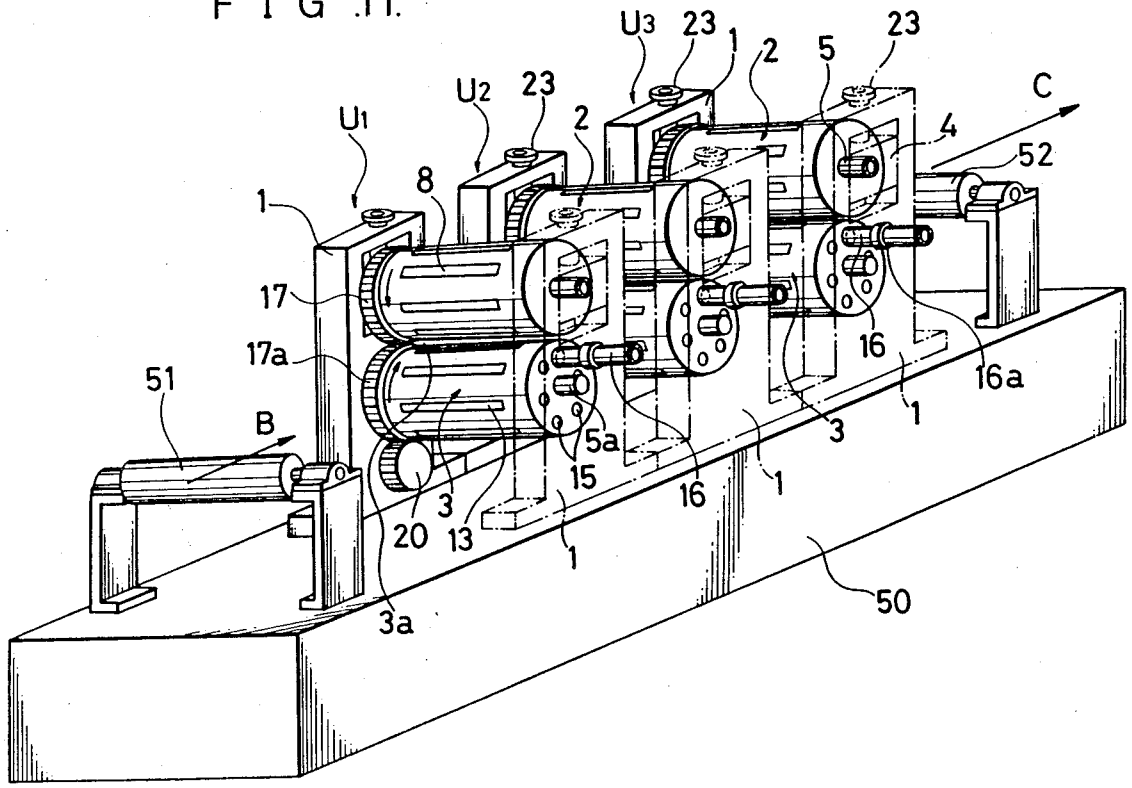
FIG. 11 is a perspective exterior view showing a multicolor printing apparatus of the present invention which comprises 3 units of the apparatus of FIG. 1.
Figure 12:
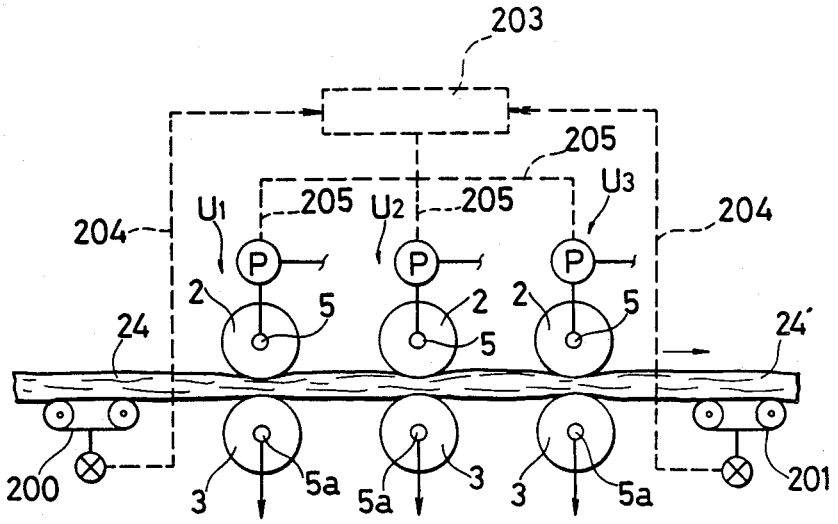
FIG. 12 is a schematic view illustrating the control system for controlling the rate of color supply.

FIG. 11 shows a multi-color printing apparatus which comprises 3 units of the apparatus of FIG. 1 as mounted on a common base 50 in series in the direction of feed of slivers for multi-color printing. In FIG. 11, $U_1$ to $U_3$ each indicates the apparatus shown in FIG. 1 and forms a unit. Indicated at 51 is a feed roller adapted to supply substrate slivers into said units $U_1$ to $U_3$, while a discharge roller for discharging colored slivers is indicated at 52. The above units $U_1$ to $U_3$ are supplied with different color compositions, respectively, so as to form a multi-color stripe pattern on the slivers. In order that the sliver will not be printed in superimposition by the three units $U_1$ to $U_3$, hollow drums 2 and 3 of the units $U_1$ to $U_3$ are driven in a predetermined timed relationship among the three units $U_1$ to $U_3$ as controlled by a conventional tuning system (not shown). Moreover, in order to vary the printing phase, e.g. the printing position of the second unit $U_2$ with respect to that of the first unit $U_1$, a conventional differential gearing (not shown) is provided in said base 50 for each unit. Furthermore, the application of vacuum suction forces to the color suction hollow drums 3 of units $U_1$ to $U_3$ is effected by independent vacuum pumps. Therefore, even if the timing of application of a vacuum suction force at the first unit $U_1$ coincides with that at the third unit $U_3$, there occurs no interference with each other. Incidentally, provided that the above units $U_1$ to $U_3$ are supplied with a vacuum suction force from a single vacuum pump, the vacuum suction force is divided into halves in the above situation so that the suction applied to the color composition at each unit is decreased so that locally the degree of coloring is reduced to cause uneven coloration as a whole. Moreover, in the multi-color printing apparatus of this embodiment, a conveyer scale 200 is disposed between said feed roller 51 and the first unit $U_1$ (FIG. 12; omitted for convenience in FIG. 11) and a second conveyer scale 201 is provided between the third unit $U_3$ and said discharge roller 52. The weight signals from said first and second conveyer scales 200, 201 are fed through a signal cable 204 to a color supply controller 203 which may for example be a known computer having the computation and signal input and output functions. This color supply controller 203 computes the difference between the measured values from said first conveyer scale 200 and second conveyer scale 201 and compares the difference value with the pre-input value of weight difference between said first and second conveyer scales 200, 201 (which is hereinafter referred to as the standard value). When a discrepancy is found between the two difference values, said color supply controller 203 transmits signals for cancellation of the discrepancy to constant-rate pumps supplying color compositions to said units $U_1$ to $U_3$ through a signal cable 205 to control the supply rates of color compositions to the color supply hollow drums 2 of the respective units $U_1$ to $U_3$. Thus, as shown in FIG. 12, the measured values at the first and second conveyer scales 200 and 201 are constantly fed to said color supply controller 203, which then computes the difference between the measured values and compares it with the standard value. If a discrepancy is found between the computed difference and the standard value, the controller 203 transmits signals for cancellation of the discrepancy to constant-rate pumps for the drum units $U_1$ to $U_3$. Therefore, even when there are variations in the fiber fineness, moisture and residual fat of substrate slivers 24, the constant-rate pumps connected directly to the respective drums of units $U_1$ to $U_3$ are controlled by the functions of said conveyer scales 200, 201 and color supply controller 203 so that the supply rates of color compositions to the color supply hollow drums 2 are properly controlled. Therefore, the incidence of uneven coloration is prevented.

By means of the above units $U_1$ to $U_3$, this multi-color printing apparatus produces a tri-color stripe pattern. Thus, referring to FIG. 13 which is an overhead view of FIG. 12, stripes of one color a are first produced by first unit $U_1$, then stripes of another color b are produced by the second unit $U_2$, leaving a ground area between stripes a and b, and finally stripes of still another color c are produced by the third unit $U_3$, leaving a ground area among stripes c, a and b. Therefore, the final sheet has a distinct tri-color stripe pattern.

Figure 13:
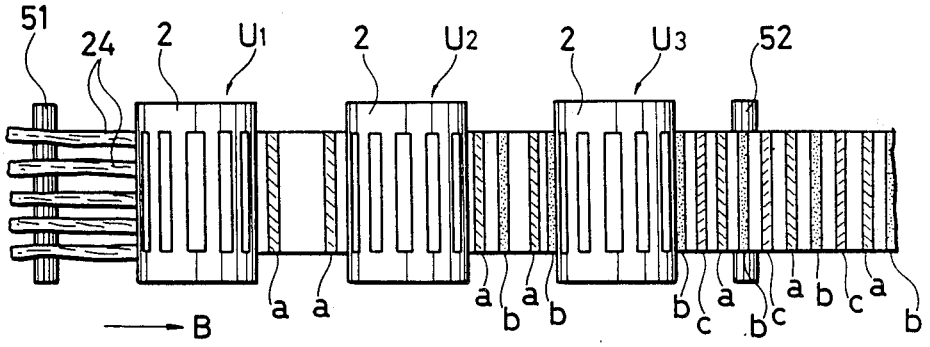
FIG. 13 is a schematic view illustrating the formation of a multi-color stripe pattern with the apparatus of FIG. 11.
Figure 14:
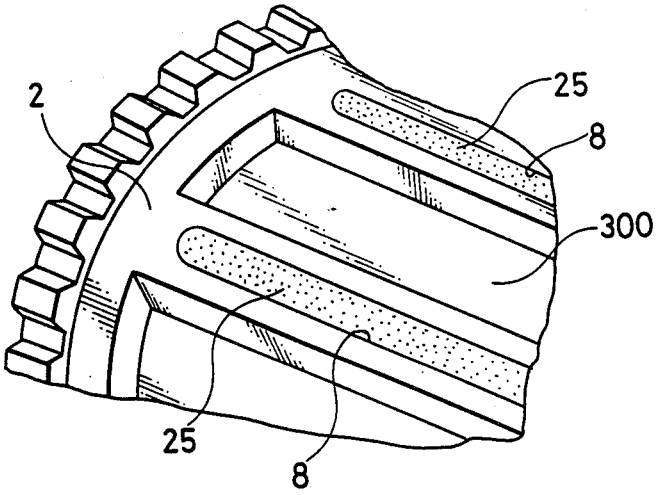
FIG. 14 is a perspective view showing, on a partially exaggerated scale, a modified apparatus based on that of FIG. 11, which has recesses formed on the circumferential surface of its color supply hollow drum.
Figure 15:
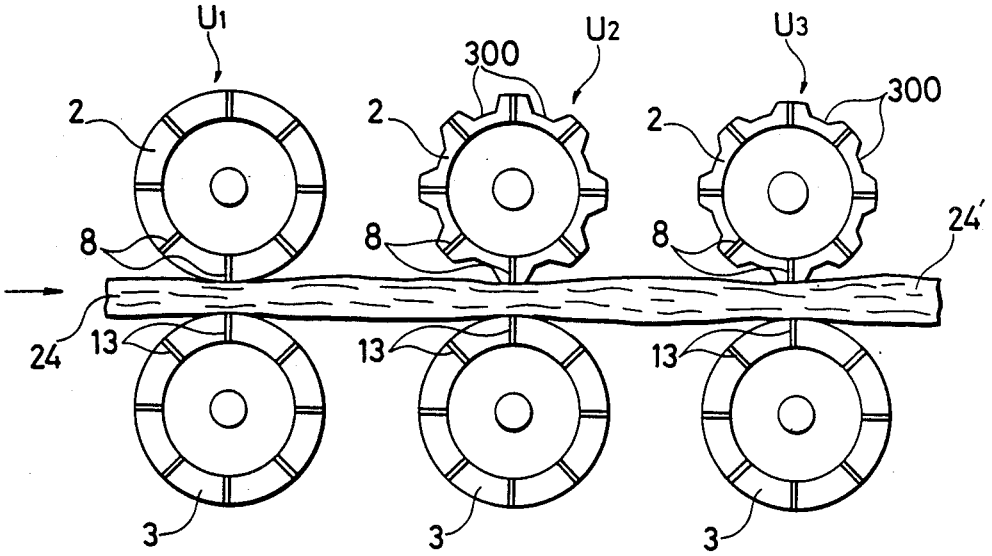
FIG. 15 is a schematic view illustrating the operation thereof.

FIGS. 14 and 15 illustrate a modification of the above multi-color printing apparatus. In this apparatus, the circumferential surface of the color supply hollow drum 2 of each of the second unit $U_2$ and third unit $U_3$ is provided with an axially-extending recess 300 between the grooves 8 and 8. Otherwise, this apparatus is identical with the apparatus of FIG. 11. By the provision of said recess 300, only the color supply grooves 8 alone are projecting from the remaining circumferential surface of the hollow drum 2. As a result, the individual stripes constituting the stripe pattern as produced by the first unit $U_1$ are not blurred by bleeding due to the pressure applied by the drums of the downstream units. Thus, in multi-color printing, as shown in FIG. 13, the slivers printed by the first unit $U_1$ pass through the second and third units $U_2$, $U_3$, and during this passage, the slivers are compressed between the color supply hollow drum 2 and color suction hollow drum 3. By this compression, the color in the stripes once formed tends to bleed out into the surrounding part of the fiber material to cause blurring of the stripes and, as a result, the whole stripe pattern is blurred. Since, in this improved apparatus, the above-mentioned recesses 300 are formed in the drums of the second and third units $U_2$, $U_3$, the color stripes once formed are not compressed so that the phenomenon of blurring is prevented. It should be understood that the above recesses 300 may be formed in the color suction hollow drum 3 or in both of the color supply and color suction drums 2 and 3.

Figure 16:
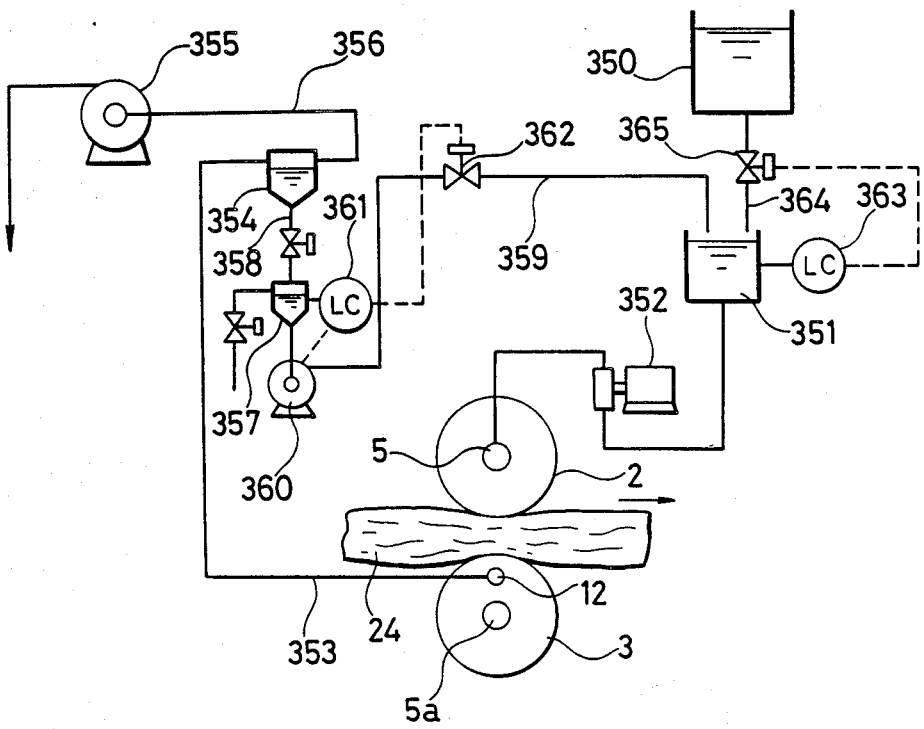
FIG. 16 is a schematic diagram illustrating the color recovery system.
Figure 17:
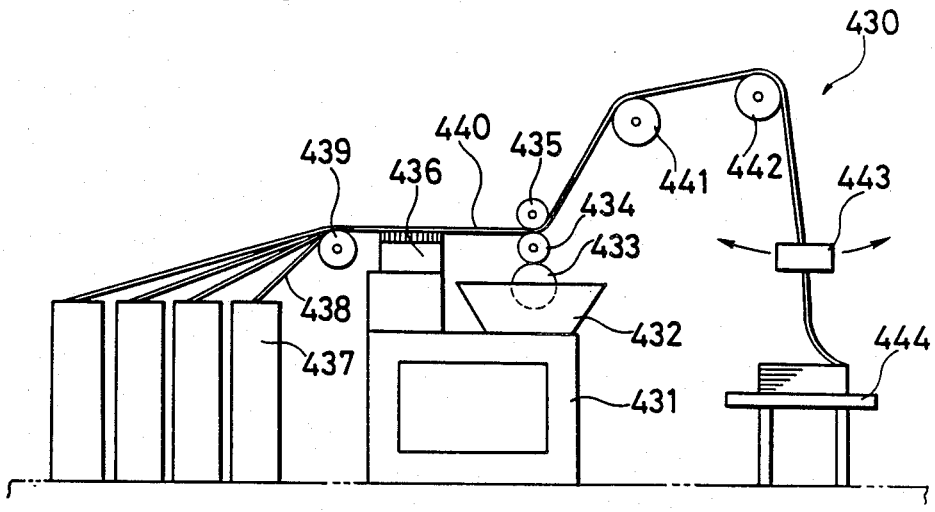
FIG. 17 is a schematic view illustrating the construction of the conventional Vigoureux printing apparatus.
Figure 18:
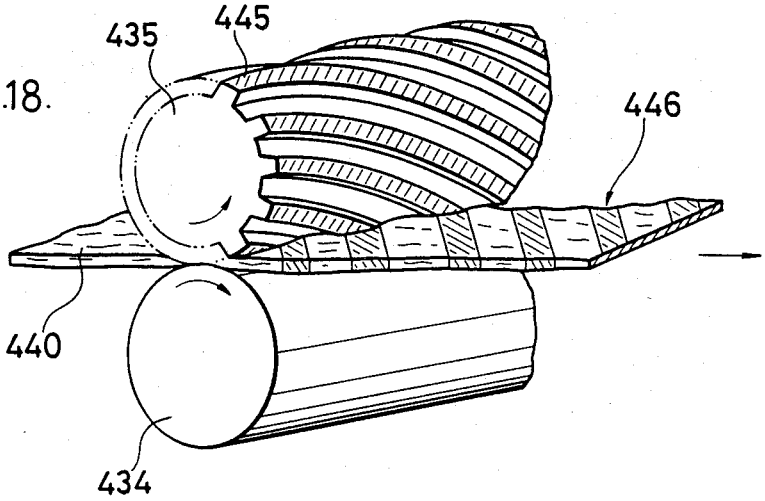
FIG. 18 is a schematic view illustrating the roll assembly of the same apparatus in operation.

FIG. 16 is a schematic view showing a color recovery system for use with the respective apparatus described hereinbefore. In the view, the color supply hollow drum is indicated at 2, the color suction hollow drum is indicated at 3, and slivers which are sandwitched between the two hollow drums 2, 3 and fed in the direction of the arrow-mark by rotation of the two hollow drums are indicated at 24. The hollow shaft 5 of said color supply hollow drum 2 is supplied with a color composition from a color tank 350 at a constant flow rate by a constant-rate pump 352 through an intermediate color tank 351. The color composition thus fed at a given rate is caused to pass through said slivers 24 from the color supply groove (not shown) formed on the circumferential surface of the color supply hollow drum 2 by the vacuum suction force of said color suction drum 3, whereby it is drawn into the suction hollow drum 3 from the color suction groove (not shown). The reference numeral 353 represents a suction pipe which transports the color composition along with air by vacuum suction and is extending to an air-liquid separation pot 354. Indicated at 355 is a vacuum pump which applies a vacuum suction force to the color suction hollow drum 3 via a vacuum pipe 356, said air-liquid separation pot 354 and said suction pipe 353. The reference numeral 357 represents a liquid storage tank which is connected to a pipe 358 extending from the bottom of said air-liquid separation pot 354 and adapted to collect and temporarily store the recovered color composition separated in the liquid-air separation pot 354. Extending from the bottom of said liquid tank 357 to said intermediate color tank 351 is a recovery pipeline 359 so that the recovered color composition stored in the liquid tank 357 is sent to said intermediate color tank 351 by the action of a delivery pump 360 disposed in said recovery pipeline 359. Indicated at 361 is a first liquid level sensor disposed within said liquid tank 357, and this level sensor is adapted to open and close a solenoid valve 362 disposed in said second recovery pipeline 359 so as to maintain the level of recovered color composition within said liquid tank 357 at a predetermined level. Indicated at 363 is a second level sensor disposed in said intermediate color tank 351 and this second level sensor is adapted to drive a solenoid valve 365 disposed in a pipe 364 extending to the bottom of said color tank 350 to said intermediate color tank 351 so as to control the level of color composition in said intermediate color tank 351 at a predetermined level. Thus, in the above arrangement, the recovered color drawn into the color suction hollow drum 3 is sent to said intermediate color tank 351, while a fresh color composition is supplied from the color tank 350 to this intermediate color tank 351 by the action of said second level sensor 363 and the two color solutions are mixed for use in said intermediate color tank 351. Therefore, the time till reuse of recovered color composition is remarkably reduced. As a result, (1) the event of impurities occurring in the recovered color reacting with the color substance to cause degradation and discoloration of the color substance is prevented and, at the same time, (2) the event of the color substance undergoing conglomeration to form large particles due to the binder effect of said impurities is prevented (the formation of large particles results in the inhibition of deposition of the color on the fiber). Consequently, stable coloration of slivers and other fibrous materials can be stably conducted.

Further, as shown by the dot-chain line in FIG. 2, a cleaning pipe 101 may be provided so that pressurized air, water or the like may be blown into the holes 12 to perform cleaning of the polyolefin sponge 25*a*.

While, in the above embodiments, the color supply hollow drum 2 is provided with supply grooves 8, each of which carries a polyvinyl formal sponge element 25, to form a color supply assembly, other alternative constructions are possible and may be adopted only if the color may be uniformly supplied. Thus, for example, slits may be provided in lieu of said color supply grooves 8 on the circumferential surface of said hollow drum 2 so that the color will be retained in the interstices of such slits or a wire-mesh screen may be provided in each slit so as to retain the color by the mesh of the screen. Furthermore, a plurality of elongated plates may be provided in said color supply groove 8 so as to retain the color by means of such elongated plates. With regard to the color suction assembly, too, whereas each suction groove 13 is stuffed with a polyolefin sponge element 25*a* in the above embodiments, this is not an exclusive choice. Thus, the color suction assembly may be of any construction only if it is capable of exerting a uniform suction force on the color composition and prevents entry of dust, etc. into the suction system. Therefore, it may for example consist of slits with or without wire-mesh screens. It may also be possible to dispose a plurality of elongated plates along the wall of the color suction groove 13.

Furthermore, while in the above embodiments only a portion of the color supplied from the color supply hollow drum 2 is consumed in impregating the sliver or other fibrous material and the remainder is recovered into the color suction hollow drum 3 and reused, it may occur depending on cases that the total amount of the color supplied is consumed in impregnating the sliver or the like and does not enter into the color suction hollow drum 3. Therefore, the term "passage" of the color through sliver in the context of the present invention includes the case in which the total amount of the supplied color is consumed for impregnation of sliver and none reaches the suction hollow drum 3.

What is claimed is:

1. A method of coloring textile materials, comprising the steps of:

supplying a color composition to at least one of a plurality of color supply means extending axially along the circumference of a color supply drum;

providing a suction force to at least one of a plurality of color suction means extending axially along the circumference of a color suction drum and in one-to-one correspondence with said plurality of color supply means in said color supply drum, wherein said color suction drum has substantially the same diameter as said color supply drum and is vertically juxtaposed with respect thereto;

continuously driving said drums such that at least said one color supply means and said one color suction means correspond with each other; and passing a continuous length of fibrous material through a clearance between said color supply drum and said color suction drum, such that said color composition is drawn from said color supply drum to said color suction drum through said fibrous material so that said fibrous material is impregnated by said color composition at predetermined intervals.

2. A color method as claimed in claim 1 wherein said vertically juxtaposed color supply and color suction drums as a unit are provided in a plurality of units as arranged in the direction of feed of said continuous length of fibrous material, whereby said continuous length of fibrous material is sequentially colored different shades at predetermined intervals.

* * * * *

UNITED STATES PATENT AND TRADEMARK OFFICE

CERTIFICATE OF CORRECTION

PATENT NO. : 4,843,670

DATED : July 4, 1989

INVENTOR(S) : NAKAHARA et al

It is certified that error appears in the above-identified patent and that said Letters Patent is hereby corrected as shown below:

On the cover page, Item [57], line 9, "vetically" should read --vertically--.

Column 3, line 38, "multicolor" should read --multi-color--.

Column 5, line 62, "with-the" should read --with the--.

Column 7, line 11, "symbol a" should read --symbol a--;
line 13, "stripes a" should read --stripes a--.

Column 8, line 25, "color a" should read --color a--;
line 26, "color b" should read --color b--;
line 28, "a and b," should read --a and b,--;
line 29, "c are" should read --c are--;
line 30, "c, a and b." should read --c, a and b.--.

Signed and Sealed this

Twenty-fourth Day of July, 1990

*Attest:*

HARRY F. MANBECK, JR.

*Attesting Officer*

*Commissioner of Patents and Trademarks*